US005915149A

United States Patent [19]

Anderson et al.

[11] Patent Number: 5,915,149

[45] Date of Patent: Jun. 22, 1999

[54] MAGNETIC BALL-ON-BELT TRANSPORT

[75] Inventors: David G. Anderson, Ontario; John H. Looney, Fairport; Thomas Acquaviva, Penfield, all of N.Y.; Randolph Cruz, Harbor Beach, Fla.

[73] Assignee: Xerox Corporation, Stamford, Conn.

[21] Appl. No.: 08/882,230

[22] Filed: Jun. 25, 1997

[51] Int. Cl.[6] ..... G03G 15/00

[52] U.S. Cl. ..... 399/124; 271/273; 399/388

[58] Field of Search ..... 399/21, 124, 388; 271/273

[56] References Cited

FOREIGN PATENT DOCUMENTS

| | | |
|---|---|---|
| 1159483 | 12/1983 | Canada . |
| 58-31366 | 2/1983 | Japan . |
| 3-172239 | 7/1991 | Japan . |
| 6-43732 | 2/1994 | Japan . |

OTHER PUBLICATIONS

Xerox Disclosure Journal, vol. 8, No. 1, Jan./Feb., p. 25, 1983.

Xerox Disclosure Journal, vol. 9, No. 1, Jan./Feb. 13, pp. 13 and 14, 1984.

*Primary Examiner*—William J. Royer

*Attorney, Agent, or Firm*—William A. Henry, II

[57] ABSTRACT

A ball-on-belt transport includes a belt with a steel ball positioned on top of the belt and a magnet on the back side of the belt with the ball forming a nip with the belt to provide necessary normal force against a conveyed sheet and thereby allowing easy lateral pulling of sheets in clearing jams from the nip. Alternatively, a steel ball is retained while in contact with a belt to apply a normal force to a sheet on the belt equal to the weight of the steel ball. The ball is encased in a housing that is surrounded by a solenoid coil such that when current is applied to the coil, it acts as a solenoid and raises the ball off the belt surface and thus releases the nip pressure.

1 Claim, 2 Drawing Sheets

MAGNETIC BALL-ON-BELT TRANSPORT

BACKGROUND OF THE INVENTION

1. Field of the Invention

This invention relates to copiers/printers, and more particularly, to an improved method and apparatus for relieving the nip pressure exerted by a weighted ball-on-belt transport in copiers/printers.

2. Description of the Prior Art

In the paper paths of copier/printer machines, it is sometimes necessary to open a nip to relieve the normal force of an idler roll. A necessity could arise, for example, when a downstream nip has control of a sheet and it is desirable to not have the sheet drag in an upstream nip.

Typically, idler rolls are raised using a solenoid, linkage, springs, and the idler roll itself. A special case exists when the upstream transport is a ball-on-belt transport. For example, in a ball-on-belt registration system, a sheet enters the registration area and the transport corrects the skew and the lateral position of the sheet, and transports it forward until the lead edge of the sheet is in a take-away roll. Initially, as soon as the sheet is free from the control of the input nip, the sheet comes under the influence of a cross roll ball/belt nip(s) and its movement is controlled entirely by the forces acting on the sheet: gravity; frictional forces; drag forces from the baffle; the drive force from the ball/belt nip(s); and if the sheet is in contact with the registration edge or front gate, the contact force from the guide or gate. If the sheet had a given skew and also a given lateral offset, the ball/belt(s) will drive the sheet forward, as well as, sidewise, to position the sheet. Removal of the sheet from the system in the event of a sheet jam may cause unwanted drag on the sheet due to the friction on the ball from the spring that acts on the ball radius. The moment created opposes the ball rotation by the sheet. This drag opposes advancement of the sheet by the belt behind it.

Thus, there is still a clear need for an improved ball-on-belt transport system that eliminates the sheet drag problem when a sheet is removed from the system.

Various prior art structures are known for allowing sheets to be removed from a belt transport including the structure shown in the Xerox Disclosure Journal, Vol. 8, Number 1, January/February, Page 25, 1983, that is directed to a paper transport and jam clearance device that includes a transport with a plurality of spaced endless belts entrained around a pair of opposed spaced rollers. Each belt had a metal strip positioned adjacent thereto. Also, in the Xerox Disclosure Journal, Vol. 9, Number 1, January/February 13, pages 13 and 14, 1984 a vertical transport device is shown that controls skewing and mistiming of sheets in a copier/printer paper path by use of magnetic skis.

SUMMARY OF THE INVENTION

Accordingly, a magnetic ball-on-belt transport is disclosed that allows easy lateral pulling of a sheet in clearing jams from a nip in a copier/printer and includes the use of a magnetic ball in conjunction with either a permanent magnet or electromagnet on the back side of the belt to provide the normal force against the sheet. The normal force can be controlled by varying the current when an electromagnet is employed. Alternatively, a steel ball is retained while in contact with a belt to apply a normal force to a sheet on the belt equal to the weight of the steel ball. The ball is encased in a housing that is surrounded by a solenoid coil such that when current is applied to the coil, it acts as a solenoid and raises the ball off the belt surface and thus releases the nip pressure.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

The invention will now be described by reference to a preferred embodiment of the magnetic ball-on-belt transport of the present invention preferably for use in a conventional copier/printer. However, it should be understood that the magnetic ball-on-belt transport method and apparatus of the present invention could be used with any machine environment in which transport of sheets is desired.

Figure 1:
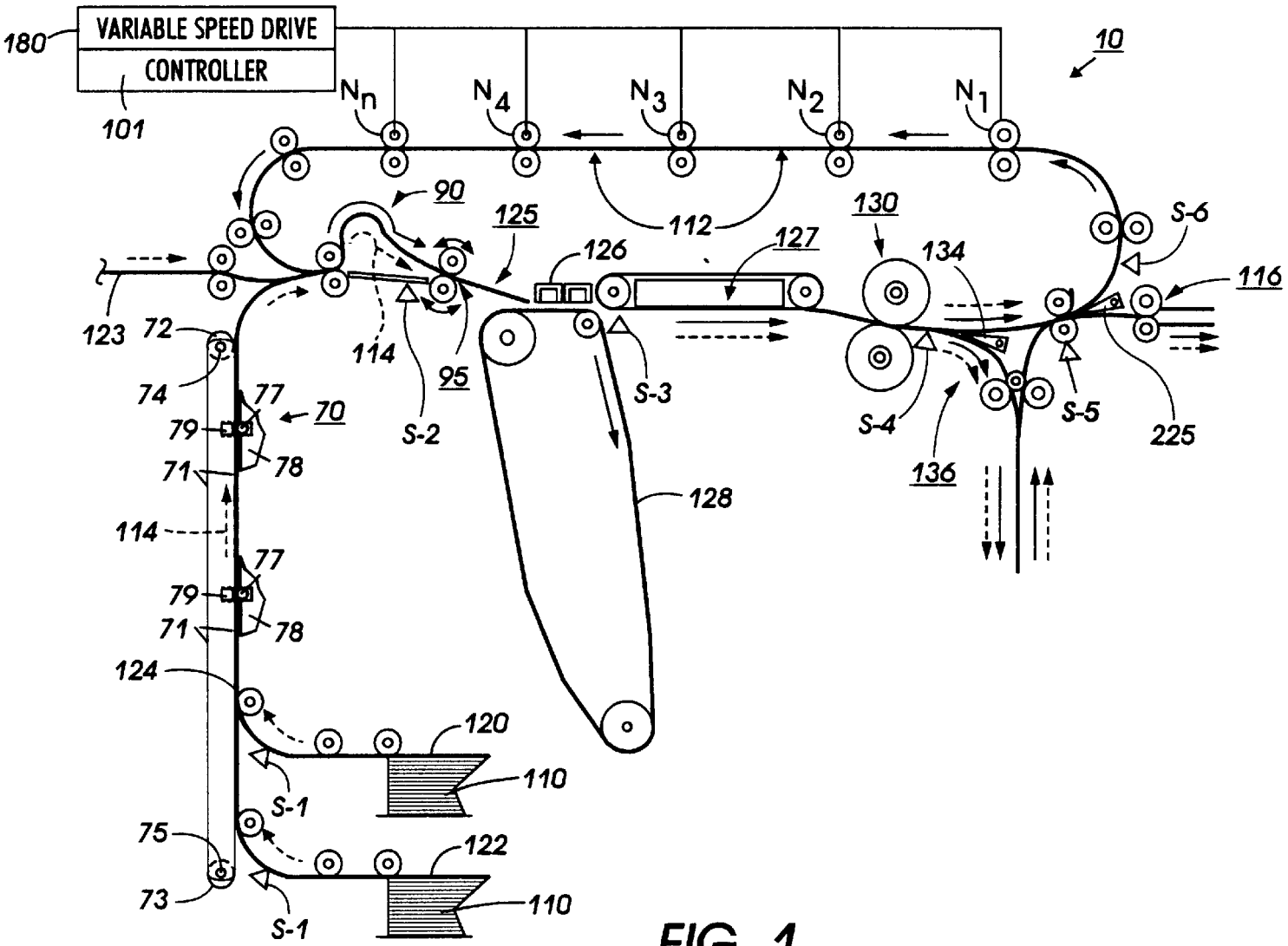
FIG. 1 is a schematic elevation view of an illustrative printing machine incorporating the magnetic ball-on-belt transport of the present invention.

For a general understanding of the features of the present invention, reference is made to the drawings. In the drawings like reference numerals have been used throughout to designate identical elements. FIG. 1 schematically depicts the various components of an illustrative electrophotographic printing machine incorporating the magnetic ball-on-belt transport method and apparatus of the present invention therein.

Describing first in further detail the exemplary printer embodiment with reference to FIG. 1, there is shown a duplex laser printer 10 by way of example of automatic electrostatographic reproducing machines of a type like that of the existing commercial Xerox Corporation "DocuTech" printer shown and described in U.S. Pat. No. 5,095,342 suitable to utilize the magnetic ball-on-belt transport of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed magnetic ball-on-belt transport for conveying sheets and making the clearing of jammed sheets easier.

Turning now more specifically to this FIG. 1 system 10, the photoreceptor is 128, the clean sheets 110 are in paper trays 120 and 122 (with an optional high capacity input path 123), the vertical sheet input transport is 70, transfer is at 126, fusing at 130, inverting at 136 selected by gate 134, and decurling at 116. There is an overhead duplex loop path 112 with plural variable speed feed rollers $N_1$–$N_n$ providing the majority of the duplex path 112 length and providing the duplex path sheet feeding nips; all driven by a variable speed drive 180 controlled by the controller 101. This is a top transfer (face down) system. Gate 225 selects between output decurler 116 and dedicated duplex return loop 112 here.

In this FIG. 1 embodiment, the endless loop duplex (second side) paper path 112 through which a sheet travels during duplex imaging is illustrated by the arrowed solid lines, whereas the simplex path 114 through which a sheet to be simplexed is imaged as illustrated by the arrowed broken lines. Note, however, that the output path leading to and beyond output decurler 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 1, the sheet is conveyed by vertical magnetic ball-on-roll transport 70 and registration transport 125 past image transfer station 126 to receive an image from photoreceptor 128. The sheet is then transported by vacuum transport 127 through fuser 130 where the image is permanently fixed or fused to the sheet. After passing through the fuser, a gate 134 either allows the sheet to move directly via output decurler 116 to a finisher or stacker, or deflects the sheet into single sheet inverter 136. That is, if the sheet is either a simplex sheet, or a completed duplex sheet having both side one and side two images formed thereon, the sheet will be conveyed via gate 134 directly to output decurler 116. However, if the sheet is being duplexed and is then only printed with a side one image, the gate 134 will be positioned by sensors S-3 and S-4 and controller 101 to deflect that sheet into the inverter 136, where that sheet will be inverted and then fed through the duplex path to sheet transport 125 for recirculation back through transfer station 126 and fuser 130 for receiving and permanently fixing the side two image to the backside of that duplex sheet, before it exits via output decurler 116. All of the sheets pass through decurler 116. Machine 10 employs sensors S-1 through S-5 in the paper path to sense sheet passage and signal controller 101 to indicate jams when appropriate.

Figure 2:
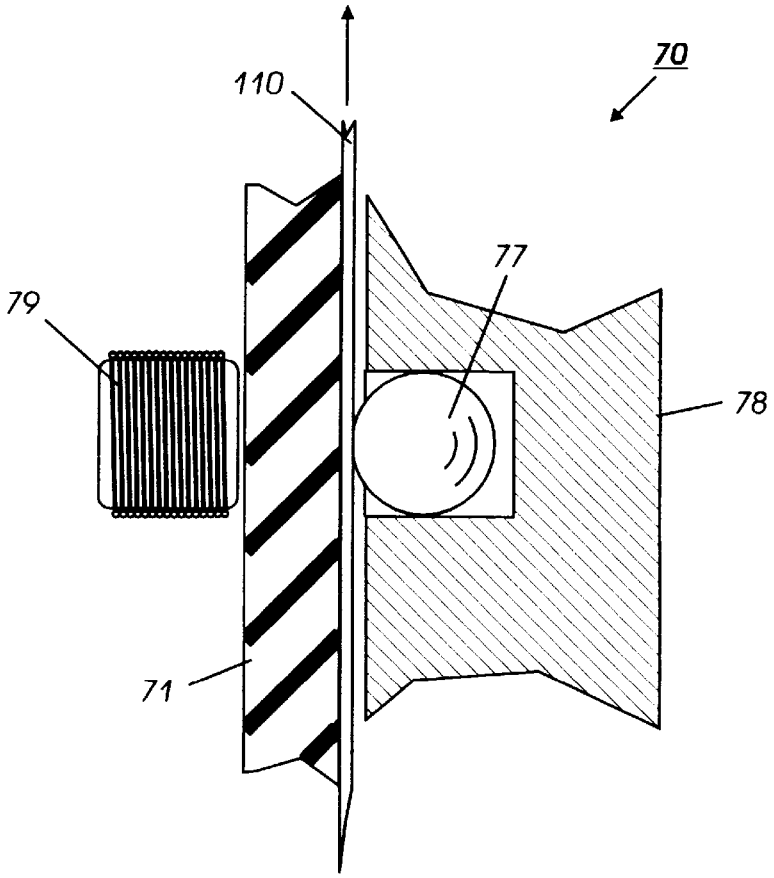
FIG. 2 is a side view of a vertical portion of the magnetic ball-on-belt copy sheet transport used in the printing machine of FIG. 1.

The magnetic ball-on-belt copy sheet transport 70 in accordance with one aspect of the present invention is shown in FIG. 2 that is adapted to transport copy sheets vertically from paper trays 120 and 122, and preferably, comprises an endless transport belt 71 that is entrained around drive pulley 72 and idler pulley 73, and mounted on rotatable shafts 74 and 75, respectively. Drive pulley 72 is mounted for rotation by shaft 74 in a counterclockwise direction in order to drive sheets in the direction of transfer station 126 as shown in FIG. 1. A conventional machine drive mechanism is connected to shaft 74 and controlled by controller 101. A magnetic ball 77 is positioned adjacent transport belt 71 within a cut-out in support 78. A conventional controllable electromagnet 79 is positioned adjacent the inner surface of belt 71 and opposite magnetic ball 77. With current applied to the electromagnet, magnetic ball 77 is drawn against a sheet 110 that is resting on a top surface of transport belt 71 to apply a normal force against sheet 110.

While one transport belt and one electromagnet are shown here, it should be understood that any number of each could be used, if desired, and that a permanent magnet could be used instead of the electromagnet. Advantages obtained by using an electromagnet include the ability to vary the normal force against the transport belt by varying the current through the magnet windings and the ability to completely disengage the nip formed between the magnetic ball and the transport belt if the orientation and geometry of the ball-on-belt transport system is such that gravity acts to either be normal to the line of action or retract the magnetic ball. This would ease jam clearance.

Figure 3:
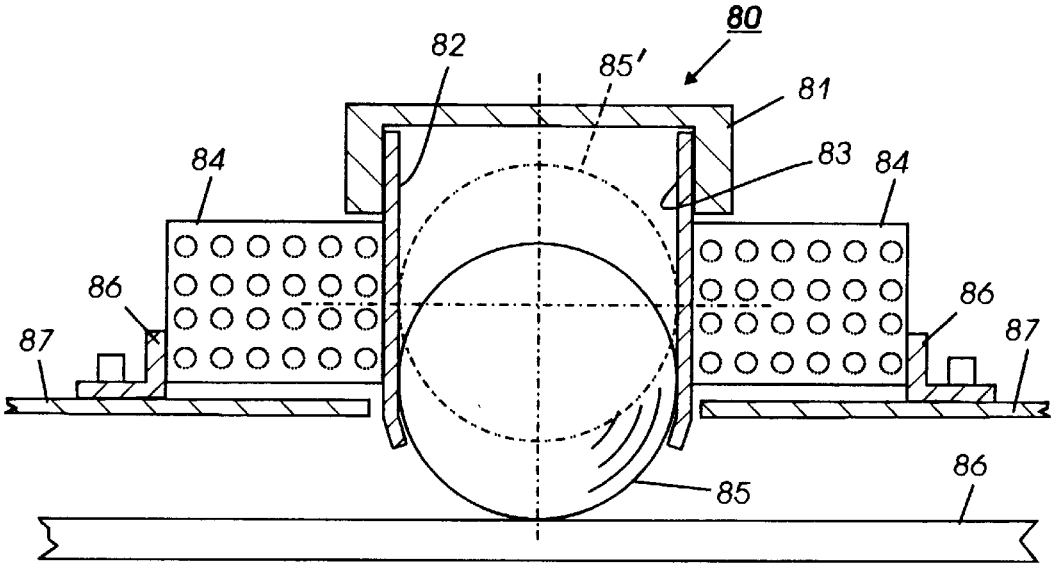
FIG. 3 is an enlarged, elevation view of an alternative embodiment of a ball-on-belt transport in accordance with the present invention showing a steel ball in a housing surrounded by an actuable solenoid coil.

An alternative ball-on-belt transport 80 is shown in FIG. 3 that takes copy sheet input from feed trays 120 and 122 and is configured to relieve the nip pressure exerted by a steel ball 85 on transport belt 86. The ball 85 is enclosed on three sides by a plastic, one-piece molded housing 81 with extending arms 82 and 83 that are bent at one end to keep the ball from falling out of the housing, but allow the ball freedom to move up an down to apply a normal force equal to its weight onto transport belt 86 or a copy sheet conveyed on the transport belt. A solenoid coil 84 surrounds arms 82 and 83 and is supported by mounting member 86 that in turn is supported by frame member 87. Housing 81 is adapted to snap into frame support 87. When current is applied to coil 84, it acts as a solenoid and raises ball 85 as shown in FIG. 3 off belt 86 to the position of 85'. Cessation of the current to coil 84 causes ball 85 to fall due to gravity to its previous nip creating position on top of belt 86. The only moving part in the device is ball 85.

It should now be apparent that a method and apparatus that makes clearing of jams in a machine easier and includes the use of either a permanent magnet or an electromagnet to provide the normal force for a ball-on-belt transport. The system is especially useful for non-horizontal transports or when control of the normal force is desired by varying the current in the electromagnet.

While the embodiment shown herein is preferred, it will be appreciated that it is merely one example, and that various alterations, modifications, variations or improvements thereon may be made by those skilled in the art from this teaching, which is intended to be encompassed by the following claims.

What is claimed is:

1. A ball-on-belt copy sheet transport assembly, comprising:

a transport belt for conveying copy sheets in a predetermined direction; and a magnetically attractable ball positioned in contacting relationship with said transport belt in order to provide normal force to a copy sheet being conveyed by said transport belt, said magnetically attractable ball being mounted in a plastic housing surrounded by an actuable solenoid coil, such that actuation of said solenoid coil causes said magnetically attractable ball to raise off said transport belt and thereby relieve normal force against the copy sheet being conveyed.

* * * * *